US007204622B2

(12) United States Patent
Dowling et al.

(10) Patent No.: US 7,204,622 B2
(45) Date of Patent: Apr. 17, 2007

(54) METHODS AND SYSTEMS FOR ILLUMINATING ENVIRONMENTS

(75) Inventors: Kevin J. Dowling, Westford, MA (US); Frederick M. Morgan, Quincy, MA (US); Michael K. Blackwell, Milton, MA (US)

(73) Assignee: Color Kinetics Incorporated, Boston, MA (US)

( * ) Notice: Subject to any disclaimer, the term of this patent is extended or adjusted under 35 U.S.C. 154(b) by 134 days.

(21) Appl. No.: 10/650,476

(22) Filed: Aug. 28, 2003

(65) Prior Publication Data

US 2004/0090787 A1 May 13, 2004

Related U.S. Application Data

(60) Provisional application No. 60/407,185, filed on Aug. 28, 2002.

(51) Int. Cl.
*F21S 4/00* (2006.01)

(52) U.S. Cl. ..... 362/471; 362/800; 362/545; 362/147; 362/153; 362/227

(58) Field of Classification Search ..... 362/471, 362/800, 543, 544, 545, 147, 148, 153, 227, 362/464, 479, 234; 340/825.52, 825.69, 340/825.72, 500, 815.6, 945, 286.01, 815.45; 315/291, 307; 116/28 R
See application file for complete search history.

(56) References Cited

U.S. PATENT DOCUMENTS 4,367,470 A * 1/1983 Tadokoro et al. ..... 340/825.77
5,086,385 A * 2/1992 Launey et al. ..... 700/83
5,136,483 A 8/1992 Schoniger et al.
5,309,277 A * 5/1994 Deck ..... 359/387
5,350,977 A * 9/1994 Hamamoto et al. ..... 315/291
5,384,519 A * 1/1995 Gotoh ..... 315/324
5,406,176 A * 4/1995 Sugden ..... 315/292
5,455,490 A 10/1995 Callahan et al.
5,638,057 A 6/1997 Williams
5,646,608 A * 7/1997 Shintani ..... 340/825.52
5,677,603 A 10/1997 Speirs et al.

(Continued)

FOREIGN PATENT DOCUMENTS

EP 0149907 A2 7/1985

(Continued)

OTHER PUBLICATIONS

Hewlett-Packard Co., Press Release, "New HP LEDs to Replace Incandescents in Automatovie Taillamps, New SnapLED Assembly Provides a Cost-Effective Solution to Create Thin Taillamps," Feb. 26, 1996, Detroit, MI.

(Continued)

*Primary Examiner*—Sandra O'Shea
*Assistant Examiner*—Sharon Payne
(74) *Attorney, Agent, or Firm*—Wolf, Greenfield & Sacks, P.C.

(57) ABSTRACT

Provided herein are methods and systems for illuminating environments, including aircraft environments. The methods and systems include facilities for providing both white and non-white illumination, with color and color temperature control, in programmed response to inputs. Methods and systems are also provided for improving the addressing of light systems in a network lighting configuration.

68 Claims, 8 Drawing Sheets

U.S. PATENT DOCUMENTS 6,016,038 A 1/2000 Mueller et al.
6,031,343 A * 2/2000 Recknagel et al. ..... 315/292
6,058,604 A 5/2000 Goodfellow
6,150,774 A 11/2000 Mueller et al.
6,166,496 A 12/2000 Lys et al.
6,188,181 B1 2/2001 Sinha et al.
6,203,180 B1 * 3/2001 Fleischmann ..... 362/471
6,211,626 B1 * 4/2001 Lys et al. ..... 315/291
6,292,901 B1 9/2001 Lys et al.
6,335,548 B1 1/2002 Roberts
6,340,868 B1 1/2002 Lys et al.
6,357,893 B1 * 3/2002 Belliveau ..... 362/285
6,441,943 B1 8/2002 Roberts
6,459,919 B1 10/2002 Lys et al.
6,508,564 B1 * 1/2003 Kuwabara et al. ..... 362/612
6,528,954 B1 3/2003 Lys et al.
6,548,967 B1 4/2003 Dowling et al.
6,577,080 B2 6/2003 Lys et al.
6,608,453 B2 8/2003 Morgan et al.
6,614,126 B1 * 9/2003 Mitchell ..... 307/9.1
6,624,597 B2 9/2003 Dowling et al.
6,636,003 B2 * 10/2003 Rahm et al. ..... 315/179
6,676,284 B1 1/2004 Wynne Willson
6,717,376 B2 4/2004 Lys et al.
6,720,745 B2 4/2004 Mueller et al.
6,774,584 B2 8/2004 Lys et al.
6,777,891 B2 8/2004 Lys et al.
6,781,329 B2 8/2004 Morgan et al.
6,788,011 B2 9/2004 Mueller et al.
6,801,003 B2 10/2004 Schanberger et al.
6,806,659 B1 10/2004 Mueller et al.
6,836,081 B2 12/2004 Swanson et al.
6,869,204 B2 3/2005 Piepgras et al.
6,883,929 B2 4/2005 Dowling
6,888,322 B2 5/2005 Dowling et al.
6,897,624 B2 5/2005 Ducharme et al.
6,936,978 B2 8/2005 Morgan et al.
6,965,205 B2 11/2005 Piepgras et al.
6,967,448 B2 11/2005 Morgan et al.
6,969,954 B2 11/2005 Lys
6,975,079 B2 12/2005 Lys et al.
7,031,920 B2 4/2006 Dowling et al.
7,038,398 B1 5/2006 Lys et al.
7,038,399 B2 5/2006 Lys et al.
7,042,172 B2 5/2006 Dowling et al.
7,113,541 B1 9/2006 Lys et al.
2002/0010518 A1 1/2002 Reid et al.
2002/0038157 A1 3/2002 Dowling et al.
2002/0048169 A1 4/2002 Dowling et al.
2002/0070688 A1 6/2002 Dowling et al.
2002/0074559 A1 6/2002 Dowling et al.
2002/0078221 A1 6/2002 Blackwell et al.
2002/0130627 A1 9/2002 Dowling et al.
2002/0145394 A1 10/2002 Morgan et al.
2002/0145869 A1 10/2002 Dowling
2002/0152045 A1 10/2002 Dowling et al.
2002/0158583 A1 10/2002 Lys et al.
2002/0176259 A1 11/2002 Ducharme
2003/0011538 A1 1/2003 Lys et al.
2003/0028260 A1 2/2003 Blackwell
2003/0057884 A1 3/2003 Dowling et al.
2003/0057887 A1 3/2003 Dowling et al.
2003/0076281 A1 4/2003 Morgan et al.
2003/0100837 A1 5/2003 Lys et al.
2003/0133292 A1 7/2003 Mueller et al.
2003/0222587 A1 12/2003 Dowling et al.
2004/0036006 A1 2/2004 Dowling
2004/0052076 A1 3/2004 Mueller et al.
2004/0090191 A1 5/2004 Mueller et al.
2004/0090787 A1 5/2004 Dowling et al.
2004/0105261 A1 6/2004 Ducharme et al.
2004/0116039 A1 6/2004 Mueller et al.
2004/0130909 A1 7/2004 Mueller et al.
2004/0178751 A1 9/2004 Mueller et al.
2004/0212320 A1 10/2004 Dowling et al.
2004/0212993 A1 10/2004 Morgan et al.
2005/0030744 A1 * 2/2005 Ducharme et al. ..... 362/231
2005/0099824 A1 5/2005 Dowling et al.
2005/0116667 A1 6/2005 Mueller et al.
2005/0151489 A1 7/2005 Lys et al.
2005/0213352 A1 9/2005 Lys et al.
2005/0213353 A1 9/2005 Lys
2005/0218838 A1 10/2005 Lys
2005/0218870 A1 10/2005 Lys
2005/0219872 A1 10/2005 Lys
2005/0231133 A1 10/2005 Lys
2005/0236029 A1 10/2005 Dowling
2005/0236998 A1 10/2005 Mueller
2005/0253533 A1 11/2005 Lys et al.
2005/0275626 A1 12/2005 Mueller
2005/0276053 A1 12/2005 Nortrup
2006/0002110 A1 1/2006 Dowling
2006/0012987 A9 1/2006 Ducharme
2006/0016960 A1 1/2006 Morgan
2006/0022214 A1 2/2006 Morgan
2006/0050509 A9 3/2006 Dowling
2006/0076908 A1 4/2006 Morgan
2006/0098077 A1 5/2006 Dowling
2006/0104058 A1 5/2006 Chemel et al.
2006/0109649 A1 5/2006 Ducharme et al.
2006/0132061 A1 6/2006 McCormick et al.
2006/0152172 A9 7/2006 Mueller
2006/0158881 A1 7/2006 Dowling
2006/0198128 A1 9/2006 Piepgras et al.
2006/0208667 A1 9/2006 Lys

FOREIGN PATENT DOCUMENTS

JP 08330076 12/1996
JP 2001-153690 6/2001
JP 2002134284 A * 5/2002

OTHER PUBLICATIONS

Proctor, P., "Bright Lights, Big Reliability," *Aviation Week and Space Technology*, Sep. 5, 1994, vol. 141, No. 10. p. 29, Abstract Only.
Pollack, A., "The Little Light Light That Could," *The New York Times*, Apr. 29, 1996, Business/Financial Desk, Section D, p. 1, col. 2, Abstract Only.
Chinnock, C., "Blue Laser, Bright Future," *Byte*, Aug. 1995, vol. 20, Abstract Only.
U.S. Appl. No. 10/325,635, filed Dec. 19, 2002, Mueller et al.
U.S. Appl. No. 11/419,995, filed May 23, 2006, Piepgras et al.
U.S. Appl. No. 11/419,998, filed May 23, 2006, Piepgras et al.

* cited by examiner

METHODS AND SYSTEMS FOR ILLUMINATING ENVIRONMENTS

CROSS-REFERENCE TO RELATED APPLICATIONS

This application claims the benefit under 35 U.S.C. §119 (e) of U.S. Provisional Application Ser. No. 60/407,185, filed Aug. 28, 2002, entitled "Methods and Systems for Illuminating Environments," which is hereby incorporated herein by reference.

BACKGROUND

Recent years have seen rapid developments in the field of lighting systems. For example, traditional lighting sources such as incandescent sources, metal halide sources and fluorescent sources have been joined by fiber optic lights and semiconductor-based light sources such as LEDs in wide use. LEDs, once confined to low-luminosity applications, have become much brighter, and a wider range of LED colors are now available than in the past. In addition, lighting system control has advanced, including the development of microprocessor- and network-based control systems. Color Kinetics, owner of U.S. Pat. No. 6,016,038, incorporated herein by reference, has developed many such lighting control methods and systems, including systems for mapping geometric positions of lights, systems for addressing pluralities of lights, sensor-feedback systems for lighting control, systems for authoring light shows and effects, systems for providing color temperature control, software systems for lighting control, and many others.

Certain environments present particular challenges and opportunities for the design of effective lighting control methods and systems. One such set of environments is transportation environments, such as lighting systems for aircrafts. Aircraft environments are very complex, with a multiplicity of hardware and software systems. Often, such systems must interface with each other, with a control system, with a maintenance system, or all of these. Aircraft environments are also subject to very demanding regulatory restrictions, such as those relating to maintenance, safety, and signal emissions. Thus, a lighting system for an aircraft environment must be sufficiently flexible and powerful to allow it to interface with such systems in compliance with the various requirements.

Aircraft environments are also rich in characteristics that offer opportunities for improved lighting. For example, there are existing aircraft lights illuminating the exterior, the cabin interior, ceilings, floors, cockpit, bathrooms, corridors, and individual seats, among other things. Today, those lights are typically white lights with very limited functionality, such as being able to turn on and off, and perhaps to change intensity in a limited number of modes. However, an opportunity exists to provide increased lighting functionality in some or all of these lighting systems, as more particularly described below.

SUMMARY

Methods and systems are disclosed herein for illuminating environments, including methods and systems for providing a lighting control signal for controlling a lighting system that has a plurality of lights disposed in a plurality of positions within the environment; providing a control system for generating a lighting control signal; providing a connector between the control system and a plurality of the lights; and providing an address of a connector, wherein a light connected to the addressed connector responds to an addressed control signal that is addressed to that connector.

In embodiments the connector is a cable having a head end and a base end, with a facility for providing the address included at the head end of the cable. The connector may be configured to receive a light system, such as a modular light system, so that the particular light system responds to control signals addressed to the address of the connector to which the light system is connected.

In embodiments, the connector provides a two-way data interface between the lights and the control system. In embodiments, the control system can communicate data with the light system, such as control data, temperature data, performance data, performance history data, light histogram data, intensity data, color temperature data, on-off status data, color data, time data, total-on-time data, light show data, lighting effect data, alarm data, maintenance data, power-usage data, system status data, customer-entered data, advertising data, branding data, communications data.

One suitable environment is a transportation environment, such as an aircraft cabin, bus interior, automotive interior, boat or ship interior, or the like.

In embodiments a facility may be provided for shielding system elements to minimize or reduce emission of interfering signals, such as RF signals.

In embodiments the environment can include another computer system, such as a steering system, a navigation system, a safety system, a sensor system, an alarm system, a maintenance system, a communications system or an entertainment system. In some cases the environment can contain seats, with light systems disposed to illuminate the environments of the seats. In some cases the environment can contain a corridor, wherein the light systems are disposed to illuminate at least one of the ceiling and the floor of the corridor. The environment can be an entertainment venue, such as theatre.

Methods and systems are provided herein for controlling a plurality of lights using the control system to provide illumination of more than one color, wherein one available color of light is white light and another available color is non-white light. White light can be generated by a combination of red, green and blue light sources, or by a white light source. The color temperature of white light can be modified by mixing light from a second light source. The second light source can be a light source such as a white source of a different color temperature, an amber source, a green source, a red source, a yellow source, an orange source, a blue source, and a UV source. For example, lights can be LEDs of red, green, blue and white colors. More generally, the lights can be any LEDs of any color, or combination of colors, such as LEDs selected from the group consisting of red, green, blue, UV, yellow, amber, orange and white. White LEDs can include LEDs of more than one color temperature.

Provided herein are methods and systems for providing illumination control for an environment. The methods and systems include disposing in the environment a plurality of intelligent connectors, each intelligent connector being capable of handling addressable lighting data from a lighting control system. In embodiments, the intelligent connector is located on the head end of a cable. In embodiments, the intelligent connector is located near the seat of a passenger in the environment, such as aircraft seat. In embodiments, the lighting control system is in communication with a non-lighting system of the environment, such as an aircraft control system. In embodiments, the non-lighting system is an entertainment system, communications system, safety system, or other system. Other embodiments include methods and systems for providing a lighting unit adapted to connect to an intelligent connector, the lighting unit capable of responding to control signals handled by the intelligent connector. In embodiments the lighting unit includes a white light mode and a non-white light mode. The white light mode may allow varying the color temperature of white light. Methods and systems described herein may also include providing control software for controlling lighting signals sent to the addressable connectors. The control software may include a facility for associating lighting control signals with data of the environment.

In embodiments, the light systems may work in connection with a secondary system for operating on the light output of the light system, such as an optic, a phosphor, a lens, a filter, fresnel lens, a mirror, and a reflective coating.

As used herein the terms "light" and "illumination source" should be understood interchangeably to include all lights, as well as other illumination sources, including LED systems, as well as incandescent sources, including filament lamps, pyro-luminescent sources, such as flames, candle-luminescent sources, such as gas mantles and carbon arch radiation sources, as well as photo-luminescent sources, including gaseous discharges, fluorescent sources, phosphorescence sources, lasers, electro-luminescent sources, such as electro-luminescent lamps, light emitting diodes, and cathode luminescent sources using electronic satiation, as well as miscellaneous luminescent sources including galvano-luminescent sources, crystallo-luminescent sources, kine-luminescent sources, thermo-luminescent sources, triboluminescent sources, sonoluminescent sources, and radioluminescent sources. Illumination sources may also include luminescent polymers capable of producing primary colors.

The term "illuminate" should be understood to refer to the production of a frequency of radiation by an illumination source. The term "color" should be understood to refer to any frequency of radiation within a spectrum; that is, a "color," as used herein, should be understood to encompass frequencies not only of the visible spectrum, but also frequencies in the infrared and ultraviolet areas of the spectrum, and in other areas of the electromagnetic spectrum, as well as different color temperatures of a particular color, such as white.

The term "LED" includes packaged LEDs, non-packaged LEDs, surface mount LEDs, chip on board LEDs and LEDs of all other configurations. The term "LED" also includes constructions that include a phosphor where the LED emission pumps the phosphor and the phosphor converts the energy to longer wavelength energy. White LEDs typically use an LED chip that produces short wavelength radiation and the phosphor is used to convert the energy to longer wavelengths. This construction also typically results in broadband radiation as compared to the original chip radiation. An LED system is one type of illumination source.

The following patents and patent applications are hereby incorporated herein by reference:

U.S. Pat. No. 6,016,038, issued Jan. 18, 2000, entitled "Multicolored LED Lighting Method and Apparatus;"

U.S. Pat. No. 6,211,626, issued Apr. 3, 2001 to Lys et al, entitled "Illumination Components,"

U.S. patent application Ser. No. 09/870,193, filed May 30, 2001, entitled "Methods and Apparatus for Controlling Devices in a Networked Lighting System;"

U.S. patent application Ser. No. 09/344,699, filed Jun. 25, 1999, entitled "Method for Software Driven Generation of Multiple Simultaneous High Speed Pulse Width Modulated Signals;"

U.S. patent application Ser. No. 09/805,368, filed Mar. 13, 2001, entitled "Light-Emitting Diode Based Products;"

U.S. patent application Ser. No. 09/663,969, filed Sep. 19, 2000, entitled "Universal Lighting Network Methods and Systems;"

U.S. patent application Ser. No. 09/716,819, filed Nov. 20, 2000, entitled "Systems and Methods for Generating and Modulating Illumination Conditions;"

U.S. patent application Ser. No. 09/675,419, filed Sep. 29, 2000, entitled "Systems and Methods for Calibrating Light Output by Light-Emitting Diodes;"

U.S. patent application Ser. No. 09/870,418, filed May 30, 2001, entitled "A Method and Apparatus for Authoring and Playing Back Lighting Sequences;"

U.S. patent application Ser. No. 10/045,629, filed Oct. 25, 2001, entitled "Methods and Apparatus for Controlling Illumination;"

U.S. patent application Ser. No. 10/158,579, filed May 30, 2002, entitled "Methods and Apparatus for Controlling Devices in a Networked Lighting System;"

U.S. patent application Ser. No. 10/325,635, filed Dec. 19, 2002, entitled "Controlled Lighting Methods and Apparatus;" and U.S. patent application Ser. No. 10/360,594, filed Feb. 6, 2003, entitled "Controlled Lighting Methods and Apparatus."

DETAILED DESCRIPTION

Figure 1:
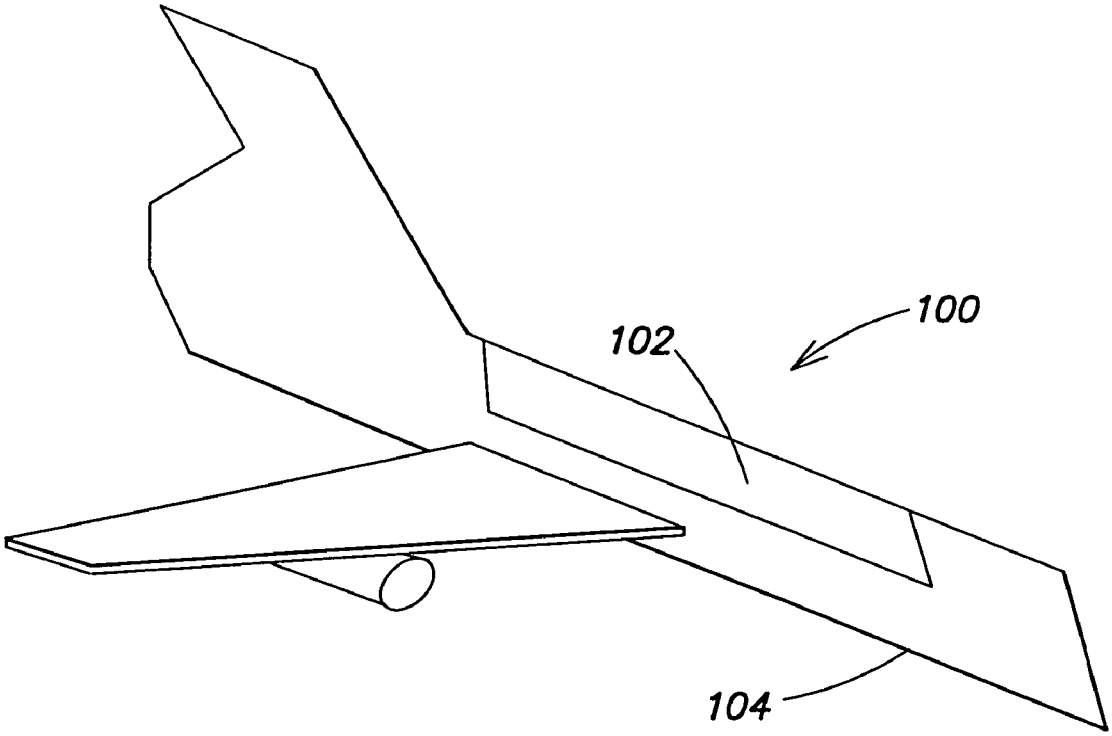
FIG. 1 depicts an aircraft environment for one or more lighting systems.

Referring to FIG. 1, an environment 100 is depicted, including an aircraft 104 with an interior 102. Aircraft environments are well known. Most include various interior environments 102, such as a cockpit, cabin, bathrooms, kitchen and service areas, as well as hardware, software and system elements for servicing those environments, such as steering, lighting, navigation, sensor, fuel, engine control, weather, security, communications, piloting and alarm systems in the cockpit; lighting, sound, safety and entertainment systems in the cabin; lighting and sanitation systems in the bathrooms, and lighting and communications systems in the kitchen and service areas. In addition, an aircraft 104 has related systems, such as a fuel system, an engine or jet system, one or more maintenance systems, various database and data manipulation systems, and many other systems.

Figure 2:
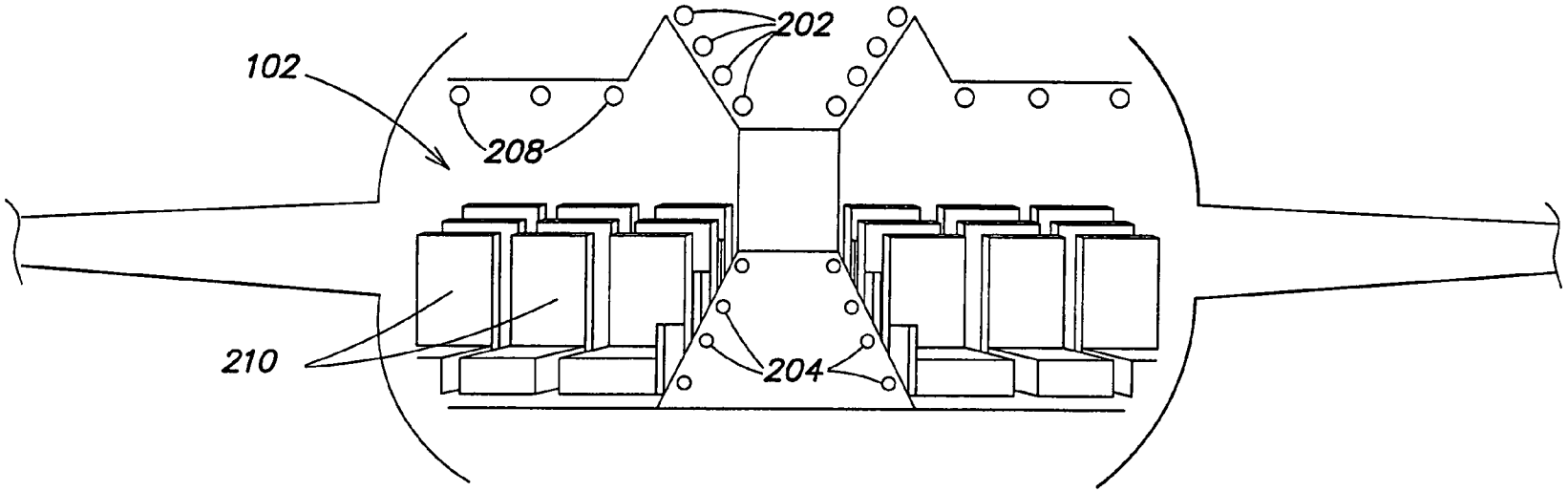
FIG. 2 depicts an interior aircraft environment having various lighting systems.

Referring to FIG. 2, an interior cabin 102 of an aircraft 104 is depicted. Like other interior aircraft environments, the cabin 102 includes a lighting system having a plurality of lights. These lights can include a plurality of ceiling lights 202, seat lights 208 to light the environments around a plurality of seats 210, and floor lights 204. Similarly, such an environment may include window lights, as well as lights positioned in various other positions on the walls, floors, ceilings or on other objects in the environment. Seat lights 208 can be positioned, for example, to illuminate a position in front of a customer (such as for reading), or to illuminate other areas, such as a display screen located on the back of the seat in front of the customer. Similarly, lights could be used to light an entertainment screen in the cabin, or to enhance entertainment content. For example, an aircraft system could be fitted with a surround light functionality, similar to that described in U.S. patent applications "LIGHTING ENTERTAINMENT SYSTEM" Ser. No. 09/213,548, Filed Dec. 17, 1998; "LIGHTING ENTERTAINMENT SYSTEM" Ser. No. 09/815,418, filed Mar. 22, 2001; "SYSTEMS AND METHODS FOR DIGITAL ENTERTAINMENT" Ser. No. 10/045,604, filed Oct. 23, 2001; "LIGHTING ENTERTAINMENT SYSTEM" Ser. No. 09/742,017, filed Dec. 20, 2000, which are incorporated by reference herein.

In conventional aircrafts, the interior lights of FIG. 2 would be conventional white lights (such as halogen lights) with minimal functionality (such as on-off capability, and perhaps limited dimming capability). In contrast, in the methods and systems disclosed herein, the lights 202, 204, 208, as well as any other lights or light systems, can provide illumination of colors other than white, as well as providing white illumination. Thus, a light 202 (or any other light or light system in the interior of the environment) can, under processor- or computer-control, provide controlled illumination and display of light in any color, at any color temperature, at any time, as programmed by the operator of the light 202. For example, the light 202 can operate in a white color mode at some times and in a non-white color mode at other times. In fact, the light 202 can, with the proper configuration of light sources and control elements, provide any selected color at any desired time. The methods and systems taught herein may be used in a number of environments. Several examples of such environments can be found in U.S. Patent Application "SMART LIGHT BULB," Application Ser. No. 09/215,624, filed Dec. 17, 1998, which is hereby incorporated by reference herein. By using computer-controlled light sources, the operator can thus provide illumination characteristics in an aircraft or similar environment that cannot be provided with conventional systems.

Selection of the proper light sources can be helpful to maximize the effectiveness of a computer-based lighting system in an environment. For example, aircraft environments require white light systems for many uses, such as safety, reading, general illumination, and the like. However, such environments can also benefit from non-white systems, such as for mood lighting, entertainment, presentation of colors for purposes of branding, and the like. Such effects may also include color temperature control, such as control based on time of day or other factors.

In embodiments it is thus desirable to include one or more white light sources, such as white LEDs of the same or different color temperature, as well as non-white sources. For example, white light can be generated by a combination of red, green (or yellow) and blue light sources, or by a white light source. The color temperature of white light can be modified by mixing light from a second light source. The second light source can be a light source such as a white source of a different color temperature, an amber source, a green source, a red source, a yellow source, an orange source, a blue source, or a UV source. In embodiments, the lights can include LEDs of red, green, blue and white colors. In other embodiments LEDs of white, amber, red, green and blue can be mixed to provide a wide range of available colors and color temperatures. More generally, the lights can include any LEDs of any color, or combination of colors, such as LEDs selected from the group consisting of red, green, blue, UV, yellow, amber, orange and white. White LEDs can include LEDs of more than one color temperature or other operating characteristic. Thus, the lights 202, 204, 208 and other interior lights (such as for cockpit, bathroom, kitchen or service area illumination) preferably comprise light sources of different colors, so that colors other than white, and different color temperatures of white, can be produced on demand.

Figure 3:
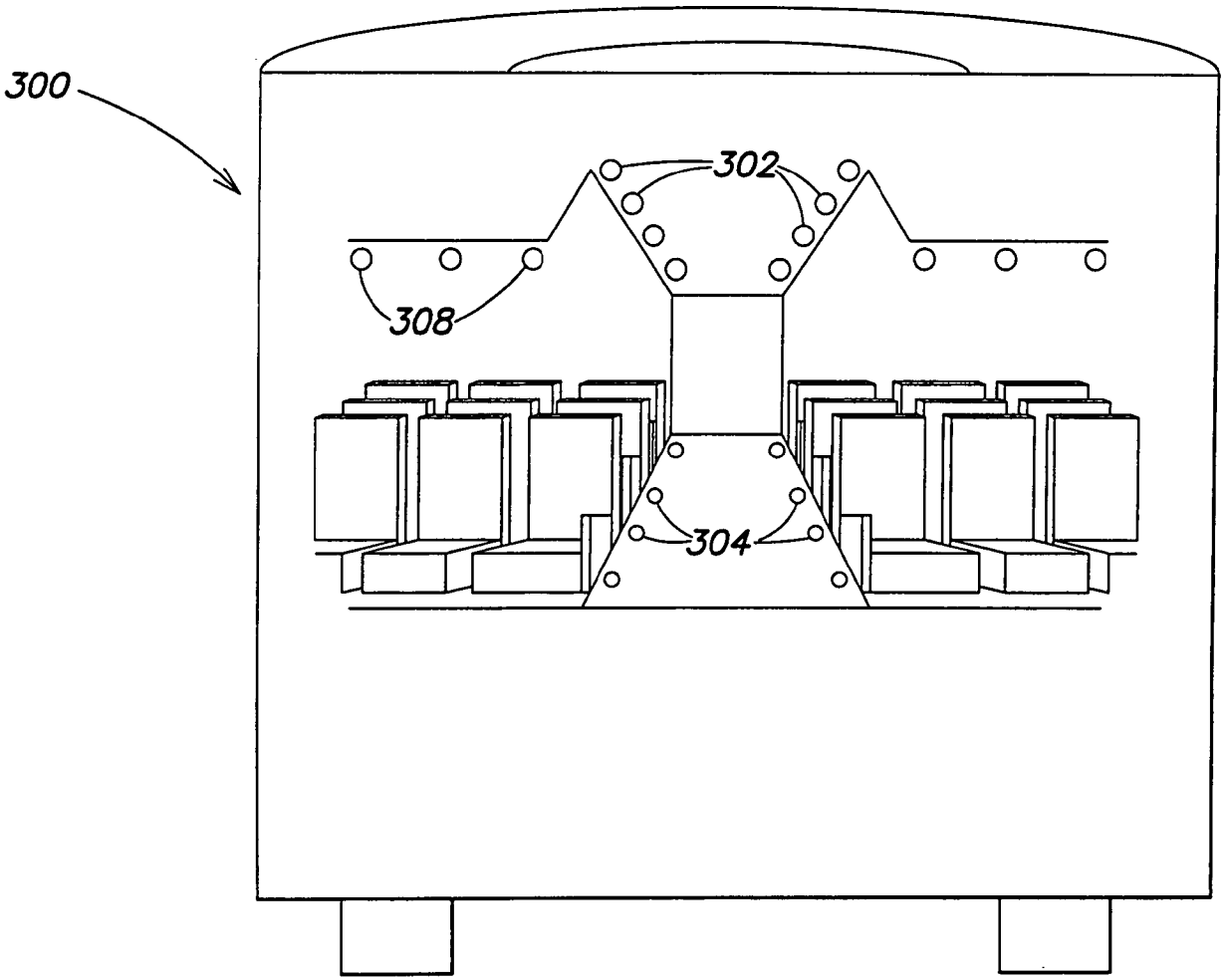
FIG. 3 depicts an interior bus environment having various lighting systems.

FIG. 3 depicts a bus environment 300, with interior lighting systems, including ceiling lights 302, floor lights 304, and seat lights 308. This environment is depicted to make the general point that many existing environmental lighting systems with conventional lighting fixtures can benefit from computer- and color-controlled lighting systems. Thus, the lights 302, 304 and 308, as well as other bus lights, can similar to the lights 202, 204 and 208 described above and elsewhere herein.

Figure 4:
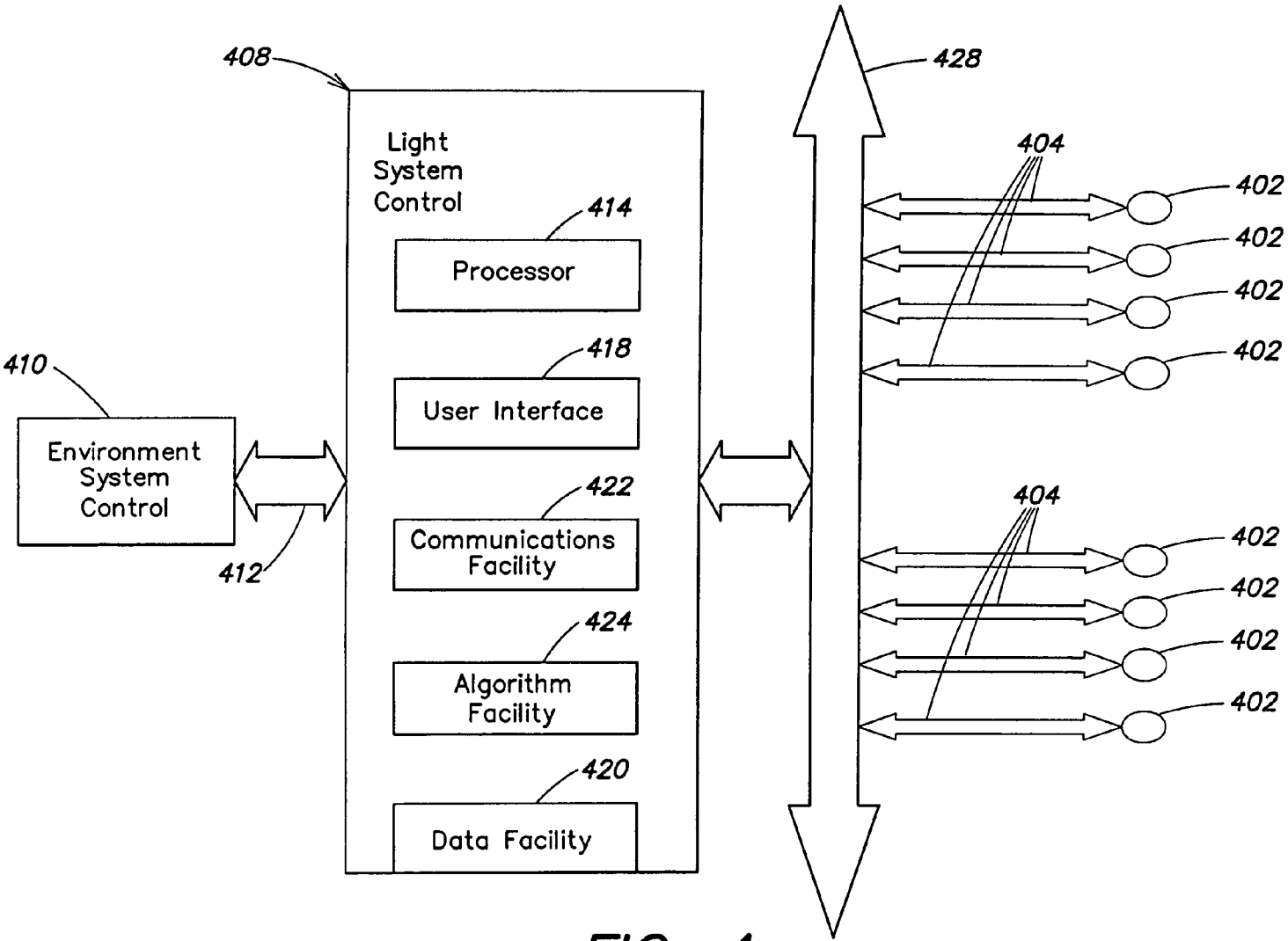
FIG. 4 is a schematic diagram with high-level system elements for a lighting control system as described herein.

Referring to FIG. 4, a schematic diagram 400 depicts high-level system elements for a computer-controlled lighting system. These include a plurality of lights 402, which may include light sources such as those described in connection with FIG. 2 above, such as LED-based lights or light fixtures, such as red, green, blue, amber, white, orange, UV, or other LEDs, disposed in any configuration. The lights 402 may be under the control of a control system 408. The control system 408 may include various system elements, such as a processor 414, as well as other control system elements, such as a user interface 418, a data facility 420, a communications facility 422 and an algorithm facility 424. It should be understood that these elements, while provided in many preferred embodiments, are optional in other embodiments. Also, it should be understood that FIG. 4 is a functional diagram, and that the control system 408, while presented as a single, integrated system, could comprise disparate system elements, including elements residing in other locations or on other devices. For example, the data facility 420 might comprise memory resident on a general purpose computer with the processor 414, but it might also comprise a database located entirely off of the aircraft, such as in a maintenance system that interfaces with the control system only periodically, such as when the aircraft is docked at a jetway.

In one preferred embodiment the control system 408 is a general purpose computer, such as a PC, laptop computer or handheld computer.

The processor 414 may be any processor, such as PIC processor offered by Microchip Corp., a general purpose computer processor, such as a Pentium-based processor, or other processor or processing element. In embodiments the control system may be integrated with other system elements of the environment, so that lighting control for the lights 402 is provided on the processor of another system of the aircraft 104, such as the maintenance system, entertainment system, sound system, navigation system, security system, or the like. In embodiments, control from one or more other system of the aircraft 104 can override control by the lighting control system 408, such as to provide alarms, security, or safety control functions that interrupt other functions, such as general lighting or entertainment functions. Thus, the algorithm facility 424 may include and execute algorithms for prioritizing lighting control commands from various lighting system control or environmental control elements.

In embodiments, the processor 414 may refer to any system for processing electrical, analog or digital signals. A processor may include a microprocessor, microcontroller, circuit, application specific integrated circuit, chip, chipset, programmable digital signal processor, biological circuit or other programmable device, along with memory such as read-only memory, programmable read-only memory, electronically erasable programmable read-only memory, random access memory, dynamic random access memory, double data rate random access memory, Rambus direct random access memory, flash memory, or any other volatile or non-volatile memory for storing program instructions, program data, and program output or other intermediate or final results. A processor may also, or instead, include an application specific integrated circuit, a programmable gate array, programmable array logic, a programmable logic device, a digital signal processor, an analog-to-digital converter, a digital-to-analog converter, or any other device that may be configured to process signals. In addition, a processor may include discrete circuitry such as passive or active analog components including resistors, capacitors, inductors, transistors, operational amplifiers, and so forth, as well as discrete digital components such as logic components, shift registers, latches, or any other separately packaged chip or other component for realizing a digital function. Any combination of the above circuits and components, whether packaged discretely, as a chip, as a chipset, or as a die, may be suitably adapted to use as a processor as described herein. It will further be appreciated that the term processor may apply to an integrated system, such as a personal computer, network server, or other system that may operate autonomously or in response to commands to process electronic signals such as those described herein. Where a processor includes a programmable device such as the microprocessor or microcontroller mentioned above, the processor may further include computer-executable code that controls operation of the programmable device.

The user interface 418 may be any user interface suitable for allowing an operator to control a light system, such as a power-cycle-based interface, a general purpose computer interface, a keyboard, a mouse, a voice- or image-recognition interface, a programming interface, a software authoring tool interface, a light show player interface, a touchpad interface, a wireless interface, or other interface suitable for entering computer control commands. In embodiments the interface may be an interface for another system of the aircraft 104, such as the interface to a conventional lighting system, an entertainment system interface, a communications system interface, a maintenance system interface, a navigation system interface, or other interface.

The methods and systems taught herein may be controlled through network and other control systems. More particular descriptions of such methods and systems can be found in the following U.S. Patent Applications: SYSTEMS AND METHODS FOR AUTHORING LIGHTING SEQUENCES, application Ser. No. 09/616,214, filed Jul. 14, 2000; A METHOD AND APPARATUS FOR AUTHORING AND PLAYING BACK LIGHTING SEQUENCES, application Ser. No. 09/870,418, filed May 30, 2001; METHOD AND APPARATUS FOR CONTROLLING A LIGHTING SYSTEM IN RESPONSE TO AN AUDIO INPUT, application Ser. No. 09/886,958, filed Jun. 21, 2001; SYSTEMS AND METHOD OF GENERATING CONTROL SIGNALS, application Ser. No. 10/163,164, filed Jun. 5, 2002, which are hereby incorporated by reference herein.

The data facility 420 is an optional system element. The data facility could be memory resident on a general purpose computer system 408, including RAM, ROM, hard disk memory, diskette, zip drive, or the like, or it could comprise a database, such as a SQL, TCL, Oracle, Access, or other database. It could comprise a data facility of another computer system, such as an entertainment system, maintenance system, safety system, or the like. In embodiments, it could comprise some or all of the above. Thus, data for lighting control could reside both in the safety system (to store safety-related lighting signals) and the entertainment system (to provide control signals for light shows) and in the general lighting system control (for general illumination). Stored control signals allow a user to program the lighting system to produce any desired effect or any color, intensity and color temperature, at any predetermined time, on demand, at random, or other various other modes. For example, the data facility 420 can store signals to create a color-chasing rainbow up and down the floor and ceiling of the aircraft cabin, or to provide desirable color temperatures of white light for sleep, reading, or watching a movie on an LCD screen. The data facility 420 can store signals that are complementary to the experience, such as those that are related to the entertainment content of a movie that is shown in a cabin or at a seat. The effects can include branding-related effects, such as those that use the signature colors of the airline in question. The data facility 420 can include stored shows, such as those pre-programmed by an author and downloaded to the system, such as by the communications facility 422.

Many lighting effects may be generated through a system according to the principles of the present invention. The references incorporated by reference herein provide many examples of such lighting effects.

In embodiments the control system 408 may include a communications facility 422, which may facility communications with other computer systems. The communications facility 422 may generally include any known communications facility, such as wire- and wireless-based communications facilities, networks, interface cards, circuits, routers, switches, software interfaces, wires, cables, connectors, circuits, RF, IR, serial and parallel ports, USB facilities, firewire facilities, copper wires, modems, Bluetooth facilities, various DSL modems, antennae, satellite communications facilities, telecommunications or other communications facilities. In embodiments the communications facility 422 and other system elements are configured to comply with regulatory requirements, such as FAA regulations on radiation emissions. Thus, various shielding facilities may be required in order to prevent the communications facility and other system elements from interfering with navigation systems and other aircraft systems.

In one preferred embodiment the communication facility 422 is that of a general purpose computer, and the control system 408 is connected to the lights 402 by a bus 428 or similar facility, as well as a physical connector 404, which together with the bus 428 provides two-way communication between the control system 408 and the lights 402. In one preferred embodiment each connector 404 or certain connectors 404 are addressable, as more particularly described below. In embodiments the bus may be a RS 485 bus or similar facility.

In some embodiments the control system 408 may also include an interface 412 to another system 410 of the environment, such as the safety system, alarm system, maintenance system, entertainment system, navigation system, power system, engine system, or the like. Via the communications facility 422 the control system 408 is capable of two-way data communications with any other computer system that is configured to communicate with the control system 408.

The control system 408 may further include the algorithm facility 424, which is a general description of any of a group of available facilities for processing instructions and, for example, providing lighting control based on the instructions. For example, in embodiments where the control system 408 receives data from the lights 402, the control system 408 could determine that a light 402 is about to fail (such as because the total "on" time for the light as calculated by the algorithm facility 424 is nearing the predicted lifetime of the light), and it could signal the maintenance system to have the light replaced at the next stop of the plane. The algorithm facility 424 can thus operate on instructions received by the communications facility 422, data from the data facility 420, and preprogrammed instructions, to generate control signals, messages, and other output in any manner desired by the user. For example, it can prioritize various lighting control signals based on various data, such as a hierarchy of systems or conditions that determine which control signal should actually be sent to the lights 402. Thus, an alarm signal would preempt an entertainment signal, and so on.

In general, it can be desirable to have addressability of light systems that are disposed in environments. By linking network addresses to physical locations, a light system operator can create light shows that are more effective than those that are created with random color effects, or ones in which the various lights systems are not well-coordinated. For example, a color-chasing rainbow effect can be easily programmed if the positions of the light systems are known, as well as their network addresses. Also, knowing individual addresses of lights 402 allows an operator to tailor light conditions to particular light. Thus, an individual sitting in a seat may wish to control the color, color temperature, luminosity, or other features of the light. With addresses, it is possible to provide individual control of lights 402, rather than just general illumination of the entire environment.

On the control side, methods and systems are known for sending addressed light signals via a communications facility 422. Examples include the DMX protocol, and there are various other network protocols that can be used to address control signals to particular addresses in a network topology. In such systems, devices that have a given address extract control bits that relate to that address, so that a single control signal (comprised of signals for each of a range of addresses), effectively provides unique control signals for each of the addresses. Each light 402 thus "knows" its address and recognizes control signals that are addressed to it, while ignoring control signals that addressed to other lights 402.

A variety of methods and systems are known for setting addresses of light systems, such as the lights 402. Examples include dipswitches that are onboard the lights, various software interfaces, and the like. Methods and systems are also known for determining light locations, so that an array of lights with addresses can be stored in a table that relates the addresses to physical locations.

The methods and systems taught herein may be controlled through addressable systems. More particular descriptions of such methods and systems can be found in the following U.S. Patent Applications: METHODS AND APPARATUS FOR CONTROLLING ADDRESSABLE SYSTEMS, application Ser. No. 60/401,965, filed Aug. 8, 2002; METHODS AND APPARATUS FOR CONTROLLING DEVICES IN A NETWORKED LIGHTING SYSTEM, application Ser. No. 10/158,579, filed May 30, 2002; AUTOMATIC CONFIGURATION SYSTEMS AND METHODS FOR LIGHTING AND OTHER APPLICATIONS, application Ser. No. 09/924,119, filed Aug. 7, 2001; METHODS AND APPARATUS FOR CONTROLLING DEVICES IN A NETWORKED LIGHTING SYSTEM, application Ser. No. 09/870,193, filed May 30, 2001; SYSTEMS AND METHODS FOR PROGRAMMING ILLUMINATION DEVICES, application Ser. No. 10/078,221, filed Feb. 19, 2002.

One problem with conventional facilities for addressing light systems is that in some environments lights are used heavily and thus may be changed regularly. If the address system is onboard the light, it may be difficult to know or find out the address of the replacement light. Thus, getting a replacement light to work properly may require knowing the right address for a particular position and setting that address properly upon light replacement. The problem with this is that aircraft maintenance takes place under very tight time schedules, so that it is desirable to avoid any complicated, difficult, or unnecessary steps. Setting a dipswitch on a light, while feasible, might require a maintenance person to look up the address of the light in a lookup table, set the light to the right dipswitch positions, and then plug in the light. This could be time consuming and error prone.

One solution to this problem is a preferred embodiment of the methods and systems disclosed herein. In such a method and system the address facility is provided at the end of the connector 404 that is proximal to the lights 402, rather than on the lights 402 themselves. Thus, the connector 404, which remains fixed in its initial position, often for the lifetime of the aircraft, can be associated with an address in a lookup table, allowing the author of an effect to direct control signals to the location of the connector. Thus, a light 402, designed to fit with the connector 404, can receive control signals that are addressed to it, based on the facility of the connector 404 to extract only that data from the general control signal of the bus 428 the particular control data that is addressed to that particular connector (and in turn to any light system that is connected to that connector). With the address facility in the connector, rather than the light 402, maintenance can consist only of plugging and unplugging any arbitrary light fixture that has the capability of responding to the control signal, without needing to take additional steps to address that fixture at the time it is put in place.

In embodiments the connector 404 is a cable having a head end and a base end, with a facility for providing the address included at the head end of the cable. The connector 404 may be configured to receive a light 402, such as a modular light system, so that the particular light responds to control signals addressed to the address of the connector to which the light is connected.

Systems and methods according to the principles of the present invention may be modular or have modular components. The references incorporated by reference herein provide examples of such modular systems and components.

Systems according to the principles of the present invention may be controlled through many other systems and methods. The references incorporated by reference herein provide examples of such control systems and methods.

Figure 5:
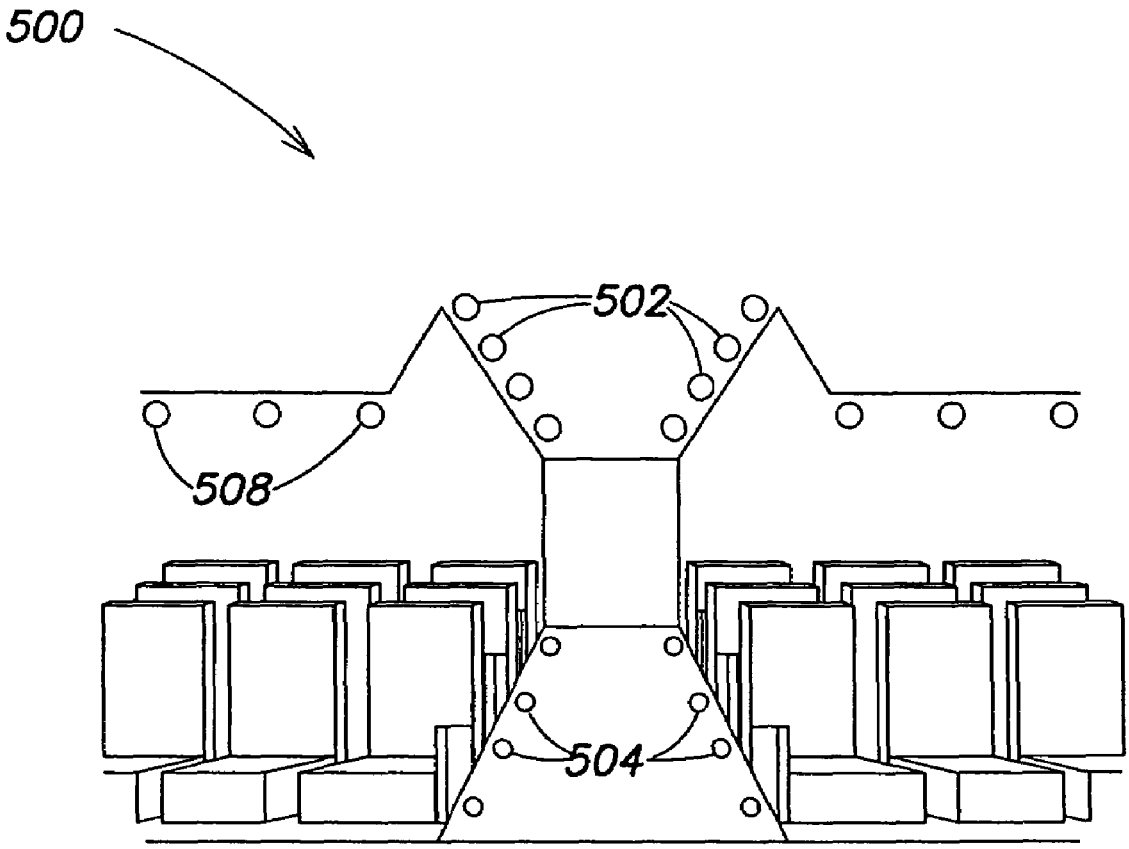
FIG. 5 depicts a seating environment having various lighting systems.

In embodiments the environment can include another computer system 410, such as a steering system, a navigation system, a safety system, a sensor system, an alarm system, a maintenance system, a communications system or an entertainment system. In some cases the environment can contain seats, with light systems disposed to illuminate the environments of the seats. In some cases the environment can contain a corridor, wherein the light systems are disposed to illuminate at least one of the ceiling and the floor of the corridor. Referring to FIG. 5, the environment 500 need not be a transportation venue. For example, it could be an entertainment venue, such as theatre, which may have floor lights 504, ceiling lights 502 and lights 508 designed to illuminate particular locations, such as seats, screens, actors, or the like. Of course, a transportation environment is, in many cases, also an entertainment venue, so it shares many characteristics, such as seats, aisles, screens, and lights.

In embodiments, the connector 404 provides a two-way data interface between the lights 402 and the control system 408. In embodiments, the control system 408 can communicate data with the lights 402, such as control data, temperature data, performance data, performance history data, light histogram data, intensity data, color temperature data, on-off status data, color data, time data, total-on-time data, light show data, lighting effect data, alarm data, maintenance data, power-usage data, system status data, customer-entered data, advertising data, branding data, communications data.

In one embodiment the control system 408 may interface with a backup power system, which provides power to the lights 402, but which may also signal the lights to operate in a certain mode, such as an emergency mode.

In embodiments, the light systems may work in connection with a secondary system for operating on the light output of the light system, such as an optic, a phosphor, a lens, a filter, fresnel lens, a mirror, and a reflective coating.

Using the two-way communication facility of the connector 404, the control system 408 can control the lights 402 in response to a wide range of inputs, whether programmed by the user, provided by other computer systems 410, provided from sensors, or provided from the lights 402.

In embodiments of the methods and systems disclosed herein, there are methods and systems for creating and using customer profiles, taking advantage of the two-way communication facility of the connector 404 and the data storage facility 420.

In many modes of transportation (planes, trains, boats, even cars) passengers are often seated for long periods of time and find ways to relax such as reading, listening to music, playing games, talking on the phone, sleeping, eating and more.

Typically in each of these transportation modes, the seating area provides conveniences and comforts such as communications access, power outlets, television, music and radio, reading lights, adjustable seat controls and more. While certain activities are limited at times (electronic devices during takeoff and landing of airplanes for example), quite a few activity options are available today for the bored passenger. From the transportation company's perspective, they also have a captive audience—hence the success of marketing in airline magazines or SkyMall®.

In several of these modes, planes and trains, for example, it is often known who occupies a particular seat. People are assigned particular seats and stay there for the duration of the trip. This knowledge and a selective amount of feedback can reveal many useful details about a passenger and allow the transportation company (airline, railroad etc) to tailor and customize future travel for that particular passenger or offer opportunities (e.g., promotions, incentives or advertising) focused on that particular passenger. The construction of these profiles is the combination of several forms of information available to the transportation company or a third-party that might provide media and activity solutions and develop profiles based on that information.

Travel agencies, departments and airlines already have profiles for passengers, especially for those who fly frequently. In part, the profile is used to quickly settle reservations based on preferences (aisle, window, front, back, 1$^{st}$ class, steerage), payment, etc. But with additional information could build a substantial profile based on activity in flight (sleeper, reader, TV viewer, classical music) and provide accommodations that are more personal and individually tailored and give the airline a differentiation based on personalized service—like a concierge at a good hotel. For example, an airline would like to be able to greet a customer as follows: "Welcome back Mr. Green—we have the following musical selections/television selections/reading materials available for you."

Disclosed herein are methods and systems for using data communications and storage facilities associated with light systems to assist in creating a knowledge base about customers and for tracking and predicting their behavior for purposes of providing useful information and services to individual customers or groups of customers.

A variety of information is necessary to construct a picture of the users, and such sensors may include status of lighting, television program selection, musical selection, power usage, seat occupancy, thermal data, and more.

Information that can be collected and stored in the data storage facility 420 can include many items, such as whether someone is in the seat, whether the reading lamp is on, whether the seat has been adjusted, whether the TV is on, and to what channel, whether a headphone is plugged in or not, what station the music is playing on, whether a video game is being played, and which one, and how well it was played. Other questions include: Is someone plugged into the power outlet? How much power is being drawn (which can serve as an indicator of what device is being used by the customer)? In the future web access is also a likely candidate for such feedback.

One such feedback mechanism is the time history of the various sensors that can be associated to communicate with the control system 408 through the connector 404 and bus 428. This provides a representation of when various activities occur and for how long. As the figures below show, a wide variety of information can be gathered and sensors and feedback can reinforce each other. For example, if the seat sensor is not triggered then any additional information does not matter.

Figure 6:
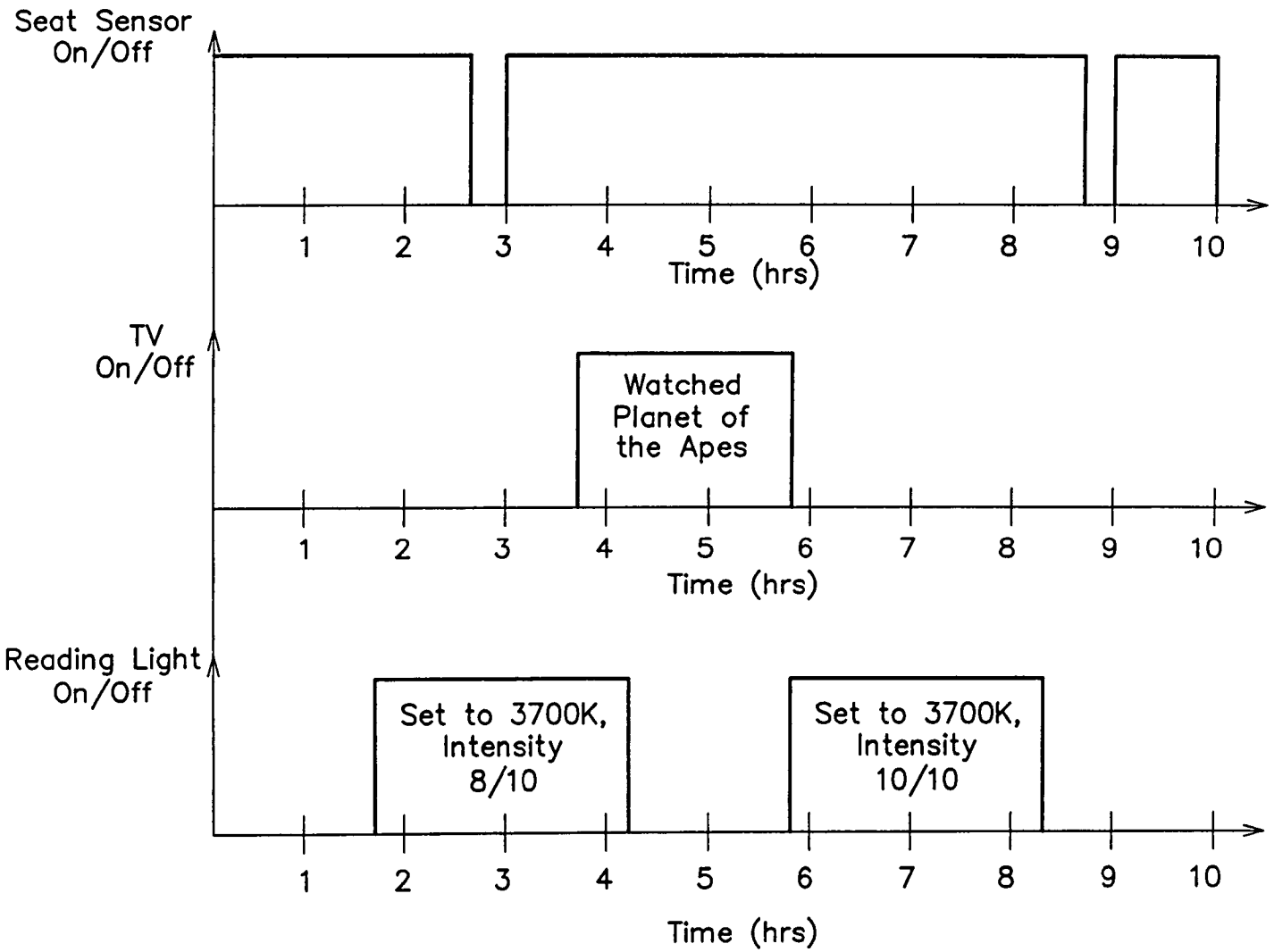
FIG. 6 depicts an example of a data histogram with data from various sensors.

FIG. 6 depicts an example of a data histogram with data from various sensors.

In addition to monitoring devices, the time histories of sensors and feedback mechanisms can be used to determine and schedule preventive maintenance. Repeated on/offs may indicate problems with the device, user interface issues, or used to have flight attendants check on someone without having the call button pressed. Device feedback from lighting systems through overcurrent or undercurrent or onboard intelligence may indicate partial or imminent failures in the device warranting a replacement process.

In one scenario, imagine a hypothetical company that we can refer to as ProfileBuilder that could manage all media and passenger interaction aboard an airplane. They can present options to those individuals for services and products in addition to providing them with media selections they prefer. In return, they can gather detailed information on preferences of individuals so they can both present those tailored options and build detailed profiles. Privacy issues will certainly be unavoidable with such information but encryption and other safeguards can insure the privacy of such information. A detailed profile can be a capsule summary of a person's life—preferences, time histories of purchases, media etc. This may be useful not only to marketing companies but to the individuals themselves.

In 2001, 622 million passengers boarded 8.8 million U.S. airline flights, down from 666 million passengers on 9 million flights in 2000. Presumably there are many connecting flights but that is still an average of about 25,000 flights per day in the US. If only 1% of those numbers are in airplanes where the enhancing seating and media is available that is still over 6M passengers where detailed preferences and high fidelity profiles can be constructed. Such passengers are also a desirable audience or demographic with presumably more education, income and spending than the average person.

As seen in FIG. 6, lights can also provide a thermal history, such as for scheduling maintenance, either on a routine or emergency basis, such as in conjunction with the aircraft's other maintenance systems.

Figure 7:
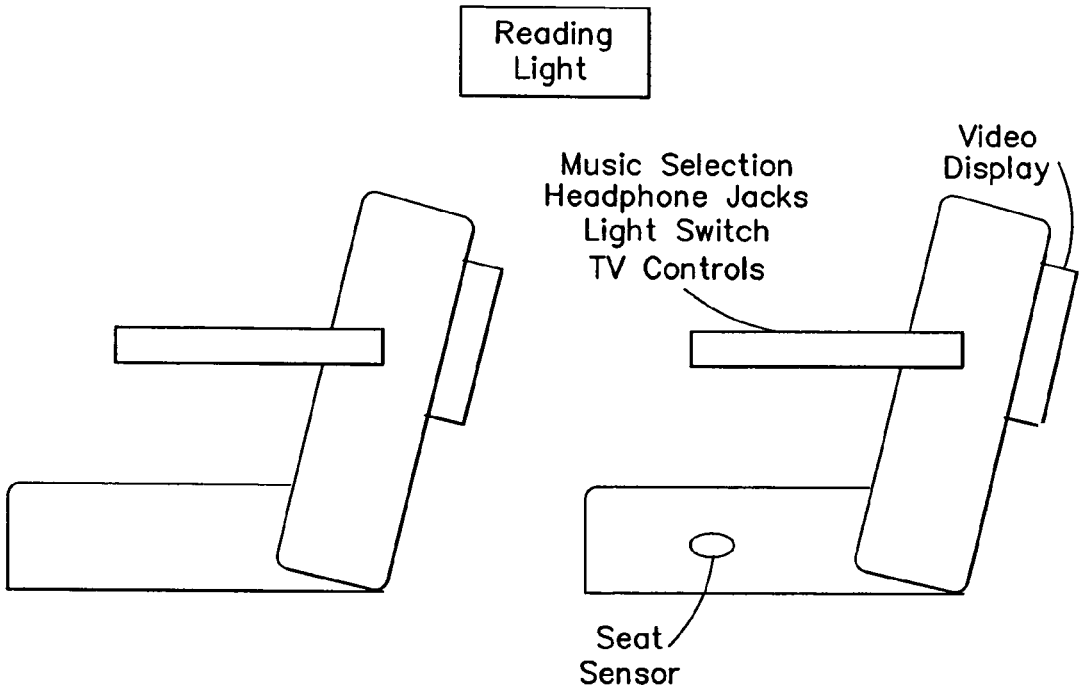
FIG. 7 depicts an environment for a user of an entertainment system that takes advantage of data communication with a light system.

An environment for a user of an entertainment system that takes advantage of data communication with a light system is depicted in FIG. 7. It should be understood that the aircraft seating environment is, in this respect, an entertainment environment not unlike those described in the patents and patent applications referenced herein. Thus, all applications, methods and systems identified therein should be understood to be capable of use in the aircraft cabin (or other transportation environment).

Figure 8:
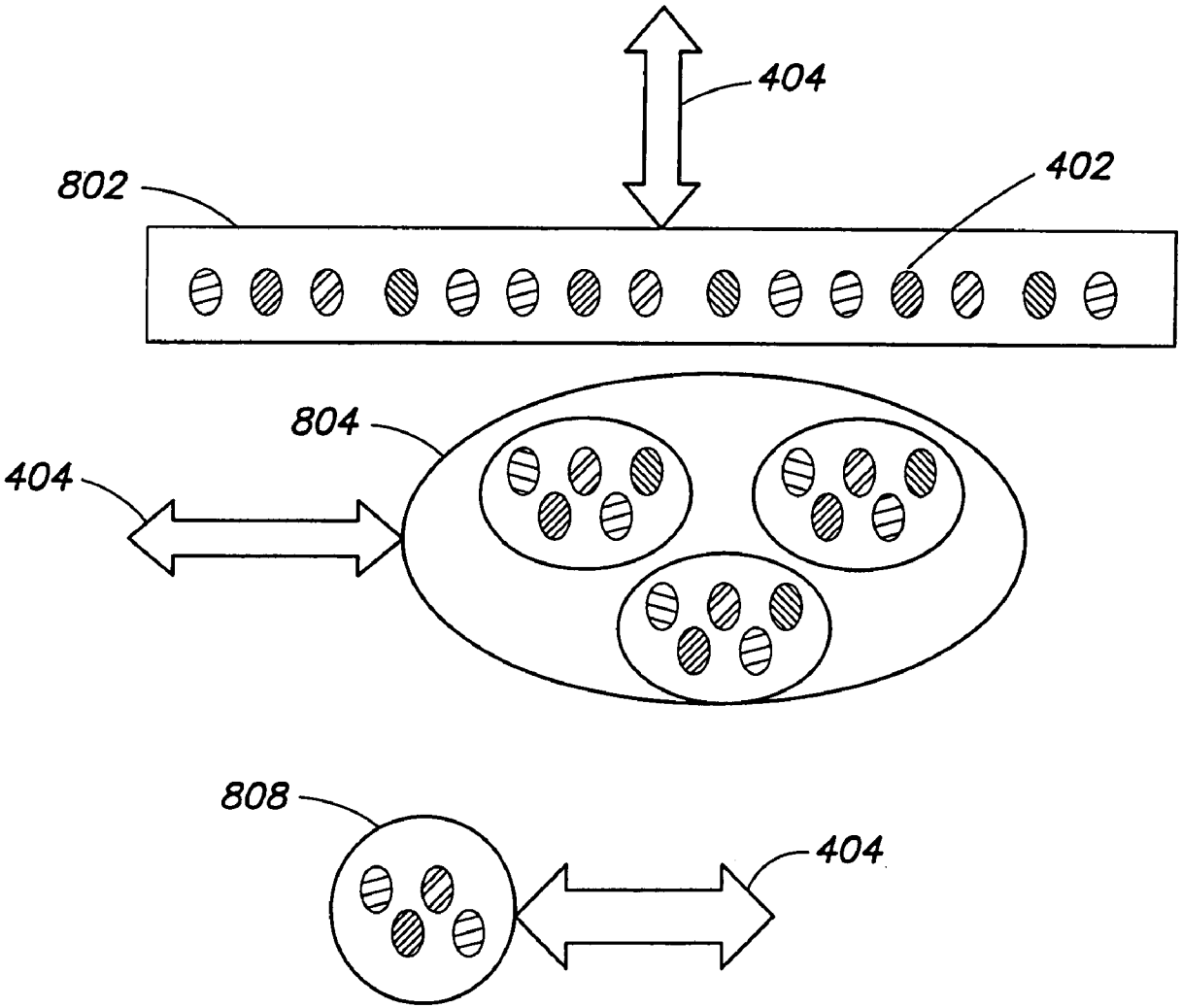
FIG. 8 depicts various examples of light systems according to various embodiments of the present invention.

Referring to FIG. 8, it can be seen that light systems can include lights 402 of many configurations, in an unlimited number of shapes and sizes. Examples include linear arrays 802, with LEDs of different colors in a line (including curvilinear arrays), as well as groupings 804 of LEDs in triads, quadruple groups, quintuple groups, etc. LEDs can be disposed in round fixtures 808, or in various otherwise shaped fixtures, including those that match fixture shapes for incandescent, halogen, fluorescent, or other fixtures. Due to small size and favorable thermal characteristics, LED-based light sources offer flexibility in fixture geometry.

While certain preferred embodiments have been described herein, other embodiments can be readily understood by one of ordinary skill in the art and are hereby incorporated by reference. All patents, patent applications, publications, specifications, regulations and other documents referenced herein are hereby incorporated in their entirety by reference.

The invention claimed is:

1. A method of illuminating an environment, comprising:

providing a lighting control signal for controlling at least one light of a plurality of lights disposed in a plurality of positions within the environment;

providing a control system for generating the lighting control signal;

providing a connector between the control system and the at least one light to provide a two-way data interface between the at least one light and the control system;

providing an address of the connector; and addressing the lighting control signal to the connector as an addressed lighting control signal, wherein the at least one light, when connected to the connector, responds to the addressed lighting control signal, and wherein the addressed lighting control signal is based at least in part on data communicated from the at least one light to the control system over the two-way data interface provided by the connector.

2. A method of claim 1, wherein the connector includes a cable having a head end and a base end, wherein the base end is coupled to the control system, and wherein providing the address of the connector comprises providing an address facility at the head end of the cable.

3. A method of claim 1, wherein the at least one light includes a modular light system, wherein the connector is configured to facilitate a plugging and unplugging of the modular light system respectively into and from the connector, and wherein the modular light system, when plugged into the connector, responds to the addressed lighting control signals.

4. A method of claim 1, wherein the at least one light communicates failure data to the control system via the two-way data interface.

5. A method of claim 1, wherein the data is selected from the group consisting of control data, temperature data, performance data, performance history data, light histogram data, intensity data, color temperature data, on-off status data, color data, time data, total-on-time data, light show data, lighting effect data, alarm data, maintenance data, power-usage data, system status data, customer-entered data, advertising data, branding data, communications data and thermal history data.

6. A method of claim 1, wherein the environment is a transportation environment.

7. A method of claim 6, wherein the environment is an aircraft cabin, further comprising providing an interface between the control system and another system.

8. A method of claim 7, further comprising:

providing a facility for shielding an element of the control system to minimize emission of interfering signals.

9. A method of claim 7, wherein the other system is at least one of a steering system, a navigation system, a safety system, a sensor system, an alarm system, a maintenance system, a communications system and an entertainment system.

10. A method of claim 1, wherein the environment contains a plurality of seats, wherein the plurality of lights are disposed to illuminate the environments of the seats.

11. A method of claim 1, wherein the environment contains a corridor, wherein the plurality of lights are disposed to illuminate at least one of the ceiling and the floor of the corridor.

12. A method of claim 1, further comprising:

controlling the at least one light based on the addressed lighting control signal so as to provide illumination including at least one of white light and non-white light.

13. A method of claim 12, wherein the at least one light includes red, green and blue light sources, wherein the illumination includes the white light, and wherein the white light is produced by a combination of radiation generated by the red, green and blue light sources.

14. A method of claim 12, wherein the at least one light includes a white light source, wherein the illumination includes the white light, and wherein the white light is generated at least in part by the white light source.

15. A method of claim 14, wherein the at least one light includes a second light source, and wherein a color temperature of the white light is determined by mixing radiation generated by the white light source and the second light source.

16. A method of claim 15, wherein the second light source is selected from the group consisting of a second white light source of a different color temperature than the first white light source, an amber source, a green source, a red source, a yellow source, an orange source, a blue source, and a UV source.

17. A method of claim 12, wherein the at least one light comprises LEDs of red, green, blue and white colors.

18. A method of claim 12, wherein the at least one light comprises LEDs selected from the group consisting of red, green, blue, UV, amber, orange and white LEDs.

19. A method of claim 18, wherein the white LEDs include white LEDs of more than one color temperature.

20. A method of claim 12, further comprising providing the data from the at least one light via onboard intelligence included in the at least one light.

21. A method of claim 20, wherein the data provided by the onboard intelligence indicates at least a partial or imminent failure of the at least one light.

22. A system, comprising:

a control system configured to generate a lighting control signal for controlling at least one light; and a connector between the control system and the at least one light to provide a two-way data interface between the at least one light and the control system, the connector having an address associated therewith, wherein the lighting control signal is an addressed lighting control signal that is addressed to the connector, wherein the at least one light, when connected to the connector, responds to the addressed lighting control signal, and wherein the addressed lighting control signal is based at least in part on data communicated from the at least one light to the control system over the two-way data interface provided by the connector.

23. A system of claim 22, wherein the connector comprises a cable having a head end and a base end, wherein the base end is coupled to the control system, and wherein the connector further comprises an address facility at the head end of the cable to set the address associated with the connector.

24. A system of claim 22, further comprising the at least one light, wherein the at least one light includes a modular light system, wherein the connector is configured to facilitate a plugging and unplugging of the modular light system respectively into and from the connector, and wherein the modular light system, when plugged into the connector, responds to the addressed lighting control signals.

25. A system of claim 22, wherein the data includes failure data associated with the at least one light.

26. A system of claim 22, wherein the data is selected from the group consisting of control data, temperature data, performance data, performance history data, light histogram data, intensity data, color temperature data, on-off status data, color data, time data, total-on-time data, light show data, lighting effect data, alarm data, maintenance data, power-usage data, system status data, customer-entered data, advertising data, branding data, communications data and thermal history data.

27. A system of claim 22, further comprising the at least one light, wherein the at least one light includes a plurality of lights disposed in a plurality of positions within an environment, and wherein the environment is a transportation environment.

28. A system of claim 27, wherein the environment is an aircraft cabin, further comprising providing an interface between the control system and another system.

29. A system of claim 28, further comprising:

a facility for shielding an element of the system to minimize emission of interfering signals.

30. A system of claim 28, wherein the other system is at least one of a steering system, a navigation system, a safety system, a sensor system, an alarm system, a maintenance system, a communications system and an entertainment system.

31. A system of claim 27, wherein the environment contains a plurality of seats, wherein the plurality of lights are disposed to illuminate the environments of the seats.

32. A system of claim 27, wherein the environment contains a corridor, wherein the plurality of lights are disposed to illuminate at least one of the ceiling and the floor of the corridor.

33. A system of claim 22, further comprising the at least one light, wherein the at least one light is configured to provide illumination including at least one of white light and non-white light, based on the addressed lighting control signal.

34. A system of claim 33, wherein the at least one light includes red, green and blue light sources, wherein the illumination includes the white light, and wherein the white light is produced by a combination of radiation generated by the red, green and blue light sources.

35. A system of claim 33, wherein the at least one light includes a white light source, wherein the illumination includes the white light, and wherein the white light is generated at least in part by the white light source.

36. A system of claim 35, wherein the at least one light includes a second light source, and wherein a color temperature of the white light is determined by mixing radiation generated by the white light source and the second light source.

37. A system of claim 36, wherein the second light source is selected from the group consisting of a second white light source of a different color temperature than the first white light source, an amber source, a green source, a red source, a yellow source, an orange source, a blue source, and a UV source.

38. A system of claim 33, wherein the at least one light comprises LEDs of red, green, blue and white colors.

39. A system of claim 33, wherein the at least one light comprises LEDs selected from the group consisting of red, green, blue, UV, amber, orange and white LEDs.

40. A system of claim 39, wherein the white LEDs include white LEDs of more than one color temperature.

41. A system of claim 33, wherein the at least one light comprises onboard intelligence to generate the data provided by the at least one light.

42. A system of claim 41, wherein the data generated by the onboard intelligence indicates at least a partial or imminent failure of the at least one light.

43. A method, comprising:

disposing in an environment a plurality of intelligent connectors, each intelligent connector being associated with an address;

addressing lighting data to the intelligent connectors from a control system based at least in part on the address associated with each intelligent connector; and controlling, via the lighting data addressed to the intelligent connectors, at least one light of a plurality of lights coupled to the intelligent connectors so as to provide illumination including at least one of a white color and a non-white color, wherein:

the at least one light of the plurality of lights comprises at least one first LED configured to generate first radiation and at least one second LED configured to generate second radiation different from the first radiation;

at least a first intelligent connector of the plurality of intelligent connectors, to which the at least one light is coupled, provides a two-way data interface between the control system and the at least one light; and the non-white color or a color temperature of the white color generated by the at least one light is determined by mixing particular amounts of the first radiation and the second radiation in response to the lighting data.

44. A method of claim 43, further comprising generating the lighting data based at least in part on data provided by the at least one light via the two-way data interface.

45. A method of claim 43, wherein the environment includes an aircraft in which the plurality of light units are disposed, wherein each intelligent connector is located proximally to a seat of an aircraft passenger, and wherein the method further comprises passing data on passenger activity though the two-way data interface.

46. A method of claim 45, further comprising communicating signals to the control system from a non-lighting system of the aircraft, wherein the control system is configured to respond to the signals from the non-lighting system to provide the lighting data.

47. A method of claim 46, wherein the non-lighting system is an entertainment system.

48. A method of claim 46, wherein the non-lighting system is a communications system.

49. A method of claim 46, wherein the non-lighting system is a safety system.

50. A method of claim 43, wherein the at least one light is an interchangeable light that is not required to recognize the address associated with the first intelligent connector.

51. A method of claim 50, wherein the at least one light includes LEDs having at least one of red, green, blue and white colors.

52. A method of claim 51, wherein the at least one light includes a white color mode and a non-white color mode.

53. A method of claim 52, wherein in the white color mode the at least one light is capable of producing different color temperatures of the white color.

54. A method of claim 51, further comprising:

providing control software for controlling the lighting data addressed to the intelligent connectors.

55. A method of claim 54, wherein the control software is configured such that the lighting data is based at least in part on information relating to the environment.

56. A system, comprising:

at least one light comprising at least one first LED configured to generate first radiation and at least one second LED configured to generate second radiation different from the first radiation;

a control system configured to generate lighting data to control the at least one light; and at least one intelligent connector to which the at least one light is coupled, the at least one intelligent connector being associated with an address and capable of handling the lighting data that is addressed to the at least one intelligent connector from the control system, the at least one intelligent connector further providing a two-way data interface between the at least one light and the control system, wherein the control system is configured to control the at least one light via the lighting data to provide illumination including at least one of a white color and a non-white color, and wherein the non-white color or a color temperature of the white color is determined by mixing particular amounts of the first radiation and the second radiation in response to the lighting data.

57. A system of claim 56, wherein the control system is configured to generate the lighting data based at least in part on data provided by the at least one light via the two-way data interface.

58. A system of claim 56, wherein the at least one intelligent connector is located proximally to a seat of a passenger in an aircraft.

59. A system of claim 58, wherein the control system is in communication with a non-lighting system of the aircraft, the control system being configured to respond to signals from the non-lighting system to provide the lighting data.

60. A system of claim 59, wherein the non-lighting system is an entertainment system.

61. A system of claim 59, wherein the non-lighting system is a communications system.

62. A system of claim 59, wherein the non-lighting system is a safety system.

63. A system of claim 56, wherein the at least one light is an interchangeable light that is not required to recognize the address associated with the at least one intelligent connector.

64. A system of claim 63, wherein the at least one light includes LEDs having at least one of red, green, blue and white colors.

65. A system of claim 64, wherein the at least one light includes a white color mode and a non-white color mode.

66. A system of claim 65, wherein in the white color mode the at least one light is capable of producing different color temperatures of the white color.

67. A system of claim 64, further comprising:

control software executed by the control system for controlling the lighting data addressed to the at least one intelligent connector.

68. A system of claim 67, wherein the control software is configured such that the lighting data is based at least in part on information relating to an environment in which the at least one light is disposed.

* * * * *